US012618325B2

(12) United States Patent
Betancourt et al.

(10) Patent No.: US 12,618,325 B2
(45) Date of Patent: May 5, 2026

(54) DYNAMIC MULTI-FLOWLINE CONTROL SYSTEM FOR DOWNHOLE TOOLS

(71) Applicant: Schlumberger Technology Corporation, Sugar Land, TX (US)

(72) Inventors: Nicholas Betancourt, Sugar Land, TX (US); Keith R. Nelson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 268 days.

(21) Appl. No.: 18/435,010

(22) Filed: Feb. 7, 2024

(65) Prior Publication Data

US 2025/0250896 A1 Aug. 7, 2025

(51) Int. Cl.
*E21B 49/08* (2006.01)
*E21B 34/16* (2006.01)

(52) U.S. Cl.
CPC ..... *E21B 49/081* (2013.01); *E21B 34/16* (2013.01)

(58) Field of Classification Search
CPC ..... E21B 49/081; E21B 34/16
See application file for complete search history.

(56) References Cited

U.S. PATENT DOCUMENTS

| | | | | |
|---|---|---|---|---|
| 8,109,157 | B2 * | 2/2012 | Kanayama | E21B 49/10 73/863.72 |
| 9,416,657 | B2 * | 8/2016 | Tao | E21B 49/10 |
| 10,753,172 | B2 | 8/2020 | Tao et al. | |
| 2018/0119547 | A1 * | 5/2018 | Slapal | E21B 34/10 |

* cited by examiner

*Primary Examiner* — Kristina M Deherrera
*Assistant Examiner* — Jean F Morello
(74) *Attorney, Agent, or Firm* — Jeffrey D. Frantz

(57) ABSTRACT

Embodiments presented provide for a multi-flowline control system and methods for dynamically switching fluid flow in downhole tools. The method may include operating the downhole tool in a first valve configuration, the downhole tool configured to sample fluid from a geological stratum, sending an actuation signal to the first valve configuration, receiving the actuation signal at the first valve configuration, altering the first valve configuration to a second valve configuration, where the first valve configuration allows for sampling of fluids from the geological stratum outside the downhole tool to the second valve configuration and where the downhole tool is configured to operate in a closed-loop configuration wherein sampling of fluids from the geological stratum is not possible, and circulating fluids within the closed loop configuration.

5 Claims, 7 Drawing Sheets

DYNAMIC MULTI-FLOWLINE CONTROL SYSTEM FOR DOWNHOLE TOOLS

CROSS-REFERENCE TO RELATED APPLICATIONS

None

FIELD OF THE DISCLOSURE

Aspects of the disclosure relate to downhole tools for sampling formation fluids and methods of sampling. More specifically, aspects of the disclosure relate to apparatus and methods related to a dynamic multi-flowline control system for downhole tools.

BACKGROUND

Conventional wireline formation sampling tools use many architectures to enable accurate sampling. The tools may consist of multiple modules that include a flow managing system, a sample retrieval carrier, a sensor data array, and a probe or packer that forms a seal with the formation. Generally, these platforms are deployed in exploratory wells and measure formation pressures. The platforms are configured to retrieve formation fluids or mud samples through use of an interior sampling bottle or chamber. Once sampling is complete, the entire tool is returned to the surface. The deployment and retrieval may be performed by wireline conveyance. The samples contained within the tool are then laboratory studied. Through the analysis of the materials contained within the sample bottle or chamber, insights are provided to engineers and operators for reservoir geological formations and mechanical properties.

Conventional wireline formation sampling tools have been developed with an independent dual flowline architecture. In such architectures, the packer or probe elements have two independent inlets for the fluid to enter the tool from the reservoir formation. Typically, one of the independent inlets is designated as a "guard line" and the other independent inlet as a "sample line".

The purpose of the guard line is to draw fluids into the tool using varying drawdown pressure and flowrate in such a way that expedites the purity or cleanliness of the sample line inlet. Thus, the guard line is used to "protect" the sample line from undue contamination and allow a pure sample to be obtained from the sample inlet. Upon taking a volume of fluid from the geological stratum, the volume of fluid is passed through a platform of modules to pump, measure, and store the fluid for return to surface. Similarly, the guard line passes through the platform pumping and has minimal measurements applied prior to being returned or discarded back into the annulus mud column of the borehole.

Conventional architectures have been designed in such a way that one flowline is designated as the primary active service line where pumping, storing, and measuring occurs. A second flowline is then used as a pass through or by-pass line with the mixed contaminated guard line fluid. At some point; however, the guard line fluid must be transferred to the primary flowline for pumping purposes. In these architectures, it is necessary to route fluids from one flowline to the other without mixing the fluids so that each flowline may be managed independently. In conventional architectures, this function is accomplished by utilizing static flowline routing plug assemblies 100. For example, U.S. Pat. No. 10,753,172, which is hereby incorporated by reference herein in its entirety, discloses examples of static flowline routing plug assemblies. Flowline plug assemblies may accomplish routing of hydraulic flows according to the needs of an operator. The flowline plug assemblies may have a single pathway that routes flow. Other embodiments are possible. Flowline plug assemblies may have two pathways, three pathways, four pathways, five pathways, and so on. Each flowline plug assembly can produce a selected flow within the tool. FIG. 1 illustrates two sample lines, for example a sample line (left) and a guard line (right). There may be a need by an operator to be able to control flow such that a different type of flow path is established. To this end, flow, through the flowline plug assembly , is routed such that the resultant flow exhibits a flowline equivalent routing structure. FIG. 1 illustrates different flow routing plugs and equivalent routing structures of connected flowlines. As can be seen, the adaptation capability of the flowline plug assembly essentially changes the overall fluid flow structure.

These assemblies are required to be installed within a downhole test apparatus 200, as illustrated in FIG. 2, prior to the job. In the illustrated embodiment, the downhole test apparatus 200 is configured into three separate sections, namely an upper head assembly 202, a chamber assembly 204 and a valve block assembly 206. Such conventional architectures do not have the ability to be "dynamic" and respond to unexpected conditions experienced within the wellbore. If, for example, engineers hypothesize that certain conditions will be experienced within the wellbore and such conditions are substantially different than expected, tools deployed downhole will need to be returned to the surface. The tool must then be stripped down by field personnel to install different routing plug assemblies that are applicable to the in-situ conditions. The tool must then be redeployed to the downhole environment. As can be seen, the valve block assembly 206 may have valve covers or entrances into the valve block assembly 206 to allow for sampling of fluids, as necessary. The positioning of these valve covers may vary depending upon the device. In some instances, sampling may occur around the entire valve block assembly 206. In other instances, lesser numbers of sampling are required, therefore less valve covers and associated internal equipment are present.

As can been understood, such retrieval, reconfiguration and redeployment of the tool can be extremely inefficient and costly to wellsite owners. Currently, no conventional architectures provide for a flexible apparatus to withstand a large variety of wellbore conditions.

There is a need to provide an apparatus and methods that are easy to operate and that provide more flexibility than conventional apparatus and methods.

There is a further need to provide apparatus and methods that do not have the drawbacks discussed above, namely field reconfiguration.

There is a still further need to reduce economic costs associated with operations and apparatus described above with conventional tools by eliminating wasted drilling operations.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are; therefore, not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a multi-flowline control system is disclosed. The system may comprise a first flow routing plug and a second flow routing plug. The system may also comprise a piston configured with a first side and a second side. The system may also comprise a first flowline configured to transport a sample fluid and a second flowline configured to transport a guard fluid. The system may further comprise a first piston flow line extending from the first side of the piston to the first flow routing plug. The system may further comprise a second piston flow line extending from the first side of the piston to the second flow routing plug. The system may also comprise a third piston flow line extending from the piston second side to the second flow routing plug; wherein the first flow routing plug and the second flow routing plug are configured to switch flow entering the first flow routing plug and the second flow routing plug from a first configuration to a second configuration. The system may a further comprise at least one fluid connection to the first flow line from the first flow routing plug. The system may further comprise at least one fluid connection to the first flow line from the second flow routing plug to the first flowline. The system may also comprise at least two fluid connections to the second flowline from the first routing plug. The system may also comprise at least one fluid connection to the second flowline from the second flow routing plug. The system may also comprise a first flow routing plug controller connected to the first flow routing plug, the first flow routing plug controller configured to switch from the first configuration to the second configuration. The system may also comprise a second flow routing plug controller connected to the second flow routing plug, the second flow routing plug controller configured to switch from the first configuration to the second configuration.

In one example embodiment, a method for dynamically switching fluid flow in a downhole tool is disclosed. The method may comprise operating the downhole tool in a first valve configuration, the downhole tool configured to sample fluid from a geological stratum. The method may further comprise sending an actuation signal to the first valve configuration. The method may further comprise receiving the actuation signal at the first valve configuration. The method may further comprise altering the first valve configuration to a second valve configuration, wherein the first valve configuration allows for sampling of fluids from the geological stratum outside the downhole tool to the second valve configuration wherein the downhole tool is configured to operate in a closed-loop configuration, wherein sampling of fluids from the geological stratum is not possible. The method may also comprise circulating fluids within the closed loop configuration.

In another example embodiment, an adapter is disclosed. The adapter may comprise a body with a first end and a second end, wherein the second end is configured to attach to a valve block. The adapter may also comprise a sample inlet within the body, the sample inlet configured to abut to a geological stratum. The adapter may also comprise a first fluid flow extending from the first end to the second end and to the sample inlet. The adapter may also comprise at least three guard flow lines extending from the first end to the second end and wherein each guard flow line has an inlet extending through a side of the body.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are; therefore, not be considered limiting of its scope, for the disclosure may admit to other equally effective embodiments.

Figure 1:
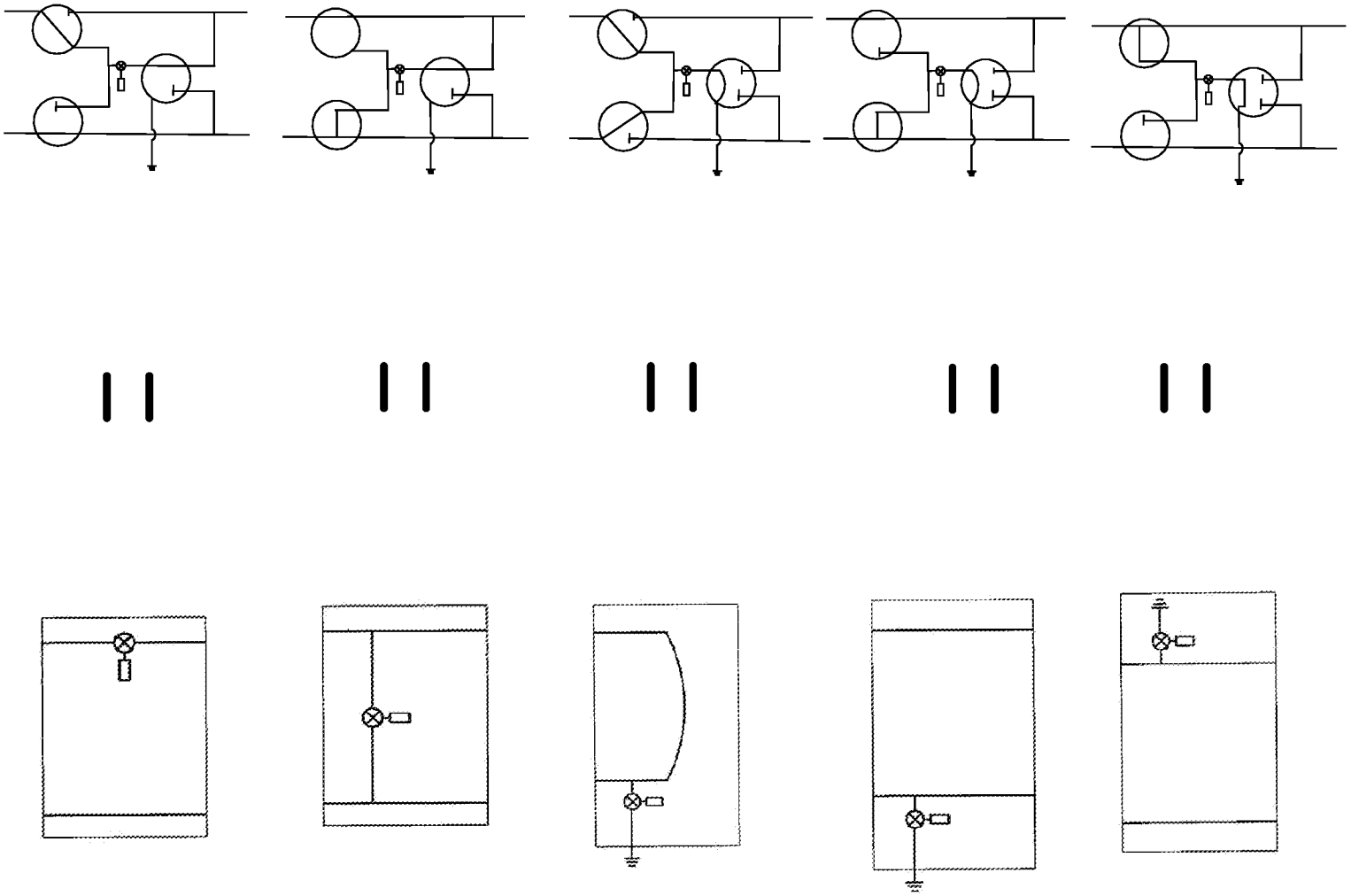
PRIOR ART FIG. 1
FIG. 1 shows hydraulic equivalent structures achievable through specific use of flow routing plug assemblies.

To facilitate understanding, identical reference numerals have been used, where possible, to designate identical elements that are common to the figures ("FIGS."). It is contemplated that elements disclosed in one embodiment may be beneficially utilized on other embodiments without specific recitation.

DETAILED DESCRIPTION

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Embodiments of the disclosure will now be discussed. The embodiments of the disclosure are an illustrative example only and should not be considered limiting. Embodiments of the disclosure provide for a dynamic multi-flowline control system that may be used with downhole tools. Such downhole tools may be used within wellbores for the recovery of fluids, such as hydrocarbons. As discussed above, conventional apparatus do not provide flexibility for use in unexpected downhole conditions. Such problems are alleviated through the embodiments illustrated. Embodiments of the disclosure allow for two modes of operation. These modes of operation will each be discussed below. A first mode of operation allows for sampling to be conducted, as normal, through a sampling port of a downhole tool. The sampling is performed by a first sample line that is dedicated to handling samples. As is often encountered; however, some downhole conditions are more challenging than others. Challenges may include large amounts of solid materials being drawn into the downhole tool during sampling. Sample lines may become clogged as well as associated sensor arrays. In conventional apparatus, such a condition would require removal of the downhole tool from the wellbore and subsequent cleaning. Such problems may be cured downhole; however, through use of the dynamic multi-flowline control system presented herein. A second flowline may be used to continue sampling using downhole pumps. Normally, this second flowline is used for providing a draw of fluids for guard inlet ports around the downhole tools. This function may be changed to allow for sampling to be accomplished through actuation of valves contained within the downhole tool. Several conditions/operations configurations are possible with the dynamic changing capability of the valves within the downhole tool. One such possible combination allows for performing a cleaning operation within the downhole tool by placing the valve configuration into a closed-loop arrangement and running fluid at higher than normal operating velocities; therefore, allowing dislodgement of the materials from the insides of pipes/fluid pathways. In embodiments, such materials may be dispersed throughout the tool. In other embodiments, a filter may be added to the downhole tool, allowing for cleaning of the circulating fluid. In embodiments, the valves may be controlled by a computing arrangement. The computing arrangement may accompany the downhole tool into the wellbore, or the computing arrangement may transmit signals down to the valves for actuation from an operator stationed at the surface.

Figure 2:
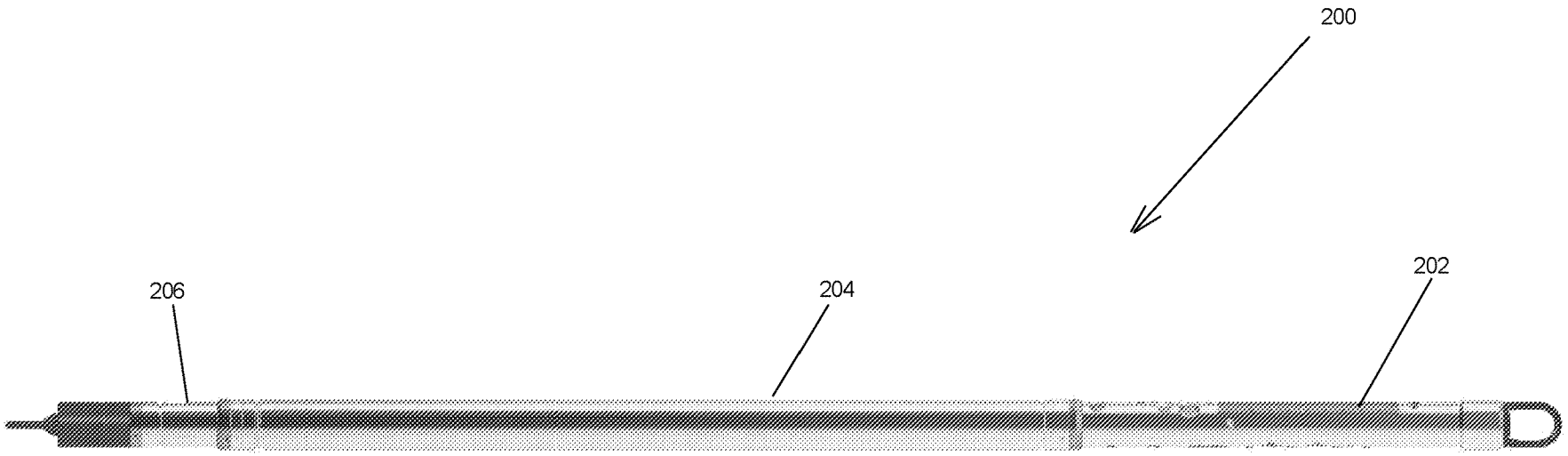
PRIOR ART FIG. 2
FIG. 2 is an example large volume sample chamber used with a conventional apparatus.
Figure 3:
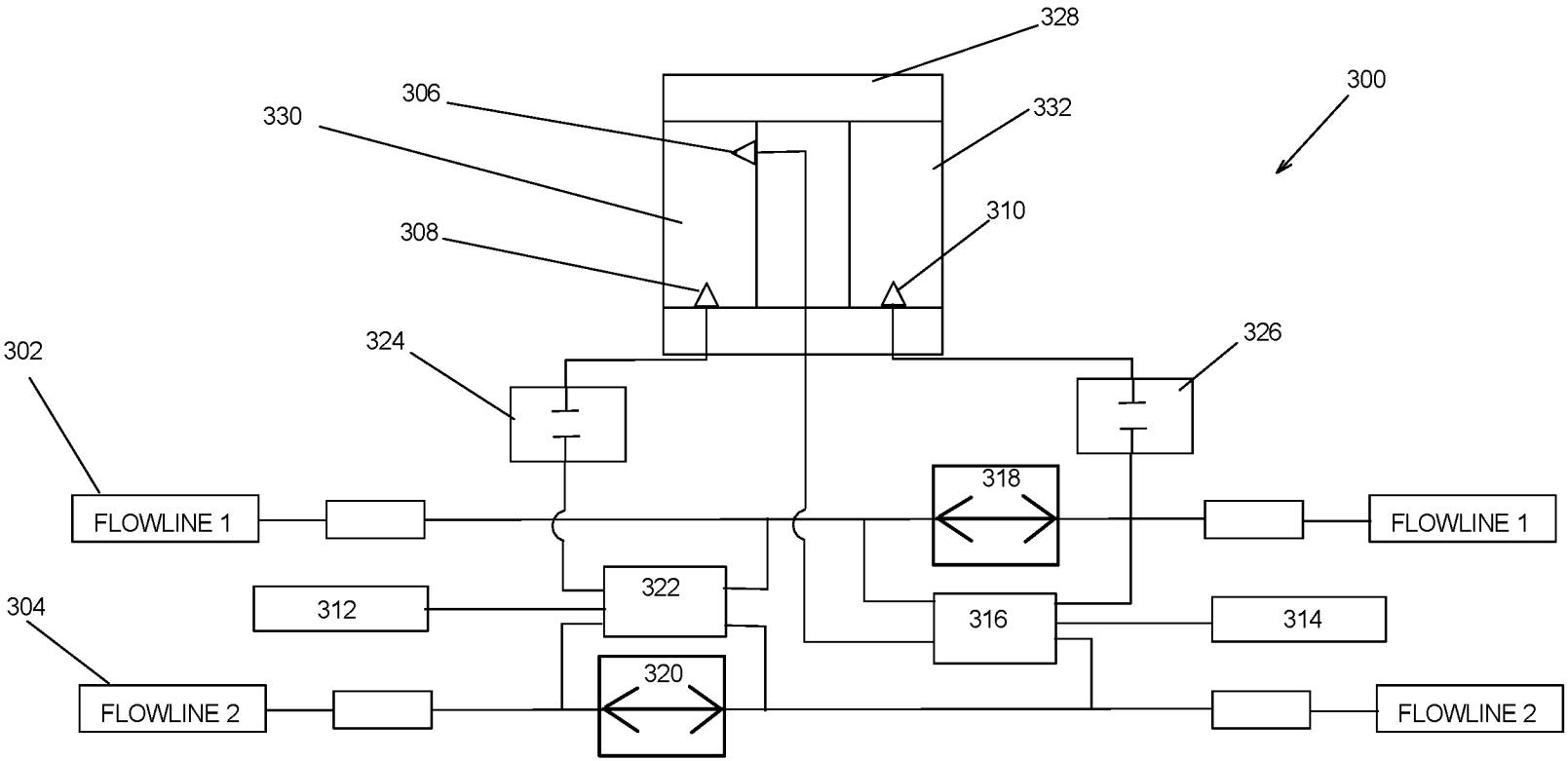
FIG. 3 is a hydraulic flow diagram in accordance with one example embodiment of the disclosure, wherein the flow system is placed in by-pass mode.

Referring to FIG. 3, a multi-flowline control system 300 is illustrated. The multi-flowline control system 300 allows for a redundant control of fluid flows within the system 300. By way of definition, aspects of the multi-flowline control system 300 may provide for dynamic control of flowlines. Dynamic is defined as being able to be changed upon either initiation of an operator or a computing arrangement. Within the system 300 flowline 1 302 is provided for conveying fluids from the surrounding wellbore environment through the system 300 and into a remainder of a downhole tool. Similarly, flowline 2 304 is provided for conveying fluids from the surrounding wellbore environment through the system 300 and into a remainder of the downhole tool 200 in FIG. 2. In these embodiments, flowline 1 302 may be used for sample purposes, wherein a fluid sample is taken from the outside environment and transported to the sample chamber 204 in FIG. 2. Flowline 2 304 may provide for guard line movement of fluid near guard inlets around the tool. In embodiments, such as the valve block 206 in FIG. 2, the multi-flowline control system 300 may be installed. In such embodiments, the valve block 206 in FIG. 2, may have four flowline valves and two flow routing plugs. During normal operations, the flow routing plugs are used to route flow in between two flowlines 302, 304, two different sample intake lines (referred to as chamber lines) and a water line that connects to a water-filled chamber on the non-sampling side of the piston 328. In the flow routing configuration, the piston 328 is removed from the sample chamber 330 allowing the chamber lines and waterline to mix freely. Within FIG. 3, two modes are possible, namely an operation mode and a by-pass mode. In FIG. 3, the configuration for the by-pass mode is illustrated. In this mode, fluid is rerouted according to the configurations set before the project begins. To this end, engineers may establish modes of operations prior to the tool being deployed within the wellbore such that different modes of operation are possible if unexpected conditions are found. These re-routing modes provide for improved reliability through redundancy that is not present within conventional apparatus and methods. Through establishment of the re-routing modes, a closed loop downhole environment may be established. The other mode, called multi-mode, allows establishment of several flowline conditions, described below.

Further referring to FIG. 3, a flowline valve 318 is established within flowline 1 302 to allow fluid to flow or stop flow. Similarly, a flowline valve 320 is established within flowline 2 304 to allow fluid to flow or stop flow. A flow routing plug controller 312 is placed for control of flow into and between flowline 1 302 and flowline 2 304. A flow routing plug controller 314 is established and placed in connection with a water-based flow routing plug 316. The water-based flow routing plug 316 is connected to flowline 1 302 as well as closed loop valve 1 326. A connection for the water line is provided to the piston 328 water side 332 through water inlet 310. The water inlet 310 may be equipped with a separate valve, in some embodiments. The sample chamber 330 side of the piston 328 provides a first sample inlet 306 and a second sample inlet 308. In embodiments, the first sample inlet 306 may be connected to the water-based flow routing plug 316 controlled by flow routing plug controller 314. The second sample inlet 308 is connected to closed loop valve 324 that in turn is connected to closed loop flow routing plug 322 controlled by flow routing plug controller 312. The closed loop flow routing plug 322 may also have connections to the flowline 1 302 as well as two connections to flowline 2 304. As illustrated, flow may progress in both directions in flowline 1 302 and flowline 2 304. In the hydraulic diagram of FIG. 3, sampling is not occurring and is "by-passed", providing a closed-loop system. Such capabilities are important for several reasons, described below.

Improved reliability is provided by the configuration provided in FIG. 3. In some instances, a sample line within the downhole tool may fail. Through the configuration in FIG. 3, if a sample line gets clogged or the sample line pumping module is removed from service, a second set of pumps used for guard lines may be used for continuing operations on the primary sample flow line, such as flowline 1 302. By doing so, sampling and measurement may be continued without stopping the operation and making surface repairs. A further benefit arrives when/if seal valves fail on the primary flowline 1 302 or flowline 2 304, a recovery method allows the job to continue without removing the entire tool from the wellbore. In FIG. 3, there are many different configurations for valves to be set or changed, thereby modifying the system. As can be seen, the water-based flow routing plug 316 has connections to the first side of the piston (left side) as well as two connections to flowline 1 302 and one connection to flowline 2 304, allowing for sampling of both sample fluid and water through inlets 306, 308, 310. Greater or lesser numbers of flow-routing plugs 316, 322 may be used in different embodiment of the disclosure. It is also contemplated, that arrangements with a third flowline are provided to either flowline 1 302 or flowline 2 304 to provide additional redundancy. Such additional flowlines can have additional flow-routing plugs that allow for switching the valve arrangements from one condition or state to another. Such additional lines may be originally designated as a guard flow line or a back-up sampling line. These additional lines; however, may be switched to provide fluid within the downhole tool if either the guard fluid flow performance or sample fluid flow performance is impacted during operation.

Normal operational mode is defined as "multi-mode". In this state, a closed flow line loop may be established within the system 300. This may be achieved through valves within the system 300 actuating such that flow of fluid is confined to a desired path.

This closed flowline loop has many useful functions. One such function is the ability to un-foul or clean sensor arrays within the tool. Often during pumping operations, the flowline flow rate is minimal and this permits debris to settle and build up on incorporated sensors. This fouling results in loss of data. Because the flow line flow rate is limited by the reservoir formation characteristics, it may not be able to be flushed at significant volumetric flow rates to clean the sensors. Such conditions; however, can be alleviated through the system 300 illustrated. A closed loop configuration for the system 300 may be established that disconnects the reservoir formation from the flowlines, while allowing the pumping modules to increase flow rate to a maximum capability. In embodiments, multiple pumps may be used to provide additional redundancy. As the fluid travels around in a circular closed flowline loop, the fluid rinses over and cleans the sensor array. Once cleaned, the system 300 can change routing back to the original multi-mode configuration and continue on with the operation. Without this functionality, the operation would require blindly operating the tool without sensor feedback or removing the tool from the wellbore to perform maintenance to remove the debris.

The routing of the flow routing plugs 322, 316 described in FIG. 3, are carefully selected in advance of the downhole deployment to ensure the proper operation. There may be a need; however to modify the flow within the tool to provide for a downhole, dynamic, hydraulic, circuitry configuration to make changes in situ. This is because observations in tool performance or circumstances have changed that necessitate configuration changes.

As will be understood, the use of flow line routing plugs 322, 316 are not the only potential possible valving configurations. Valves may be placed within different portions of the system such that valves close or seal volumes within the valve block 206 so that additional volumes of fluids may be trapped and returned to the surface. Such volumes may be used in testing where it is not required to have fluid contained within a temperature controlled sample bottle. In these embodiments; therefore, greater amounts of fluid may be sampled. Such valve installations may have the ability to prevent flow within a confined space in not only the valve block 206 but other spaces within the overall tool. Such valve installations can be opened and closed, upon demand, such that different portions of piping within the tool can correspond to different samples taken at different locations, such as at greater or lesser depths. In such embodiments; therefore, a variety of samples may be obtained at different elevations, allowing operators to establish fluid conditions at a variety of locations.

In further embodiments, multiple pumps may be used within the valve block 206 or in other areas of the tool 200. With these adaptable components, operators may allow for one sample line to be used, both the sample line and the guard line to be used, and in other configurations, allowing the lines to be "switched". In such embodiments; therefore, failure of a single pump would not cause withdrawal of the tool 200 from the wellbore, wherein operators can switch to an alternative pump for sampling from either line. Such configurations are not possible in conventional apparatus and are a great improvement for overall tool reliability and flexibility, heretofore unachieved. Flows, in fact, may be sampled in a conventional way, or may be "reversed" such that flow routes to different areas of the tool 200 based upon the driving force of the pumps being applied, through valve configuration, at different positions within the tool 200.

Figure 7:
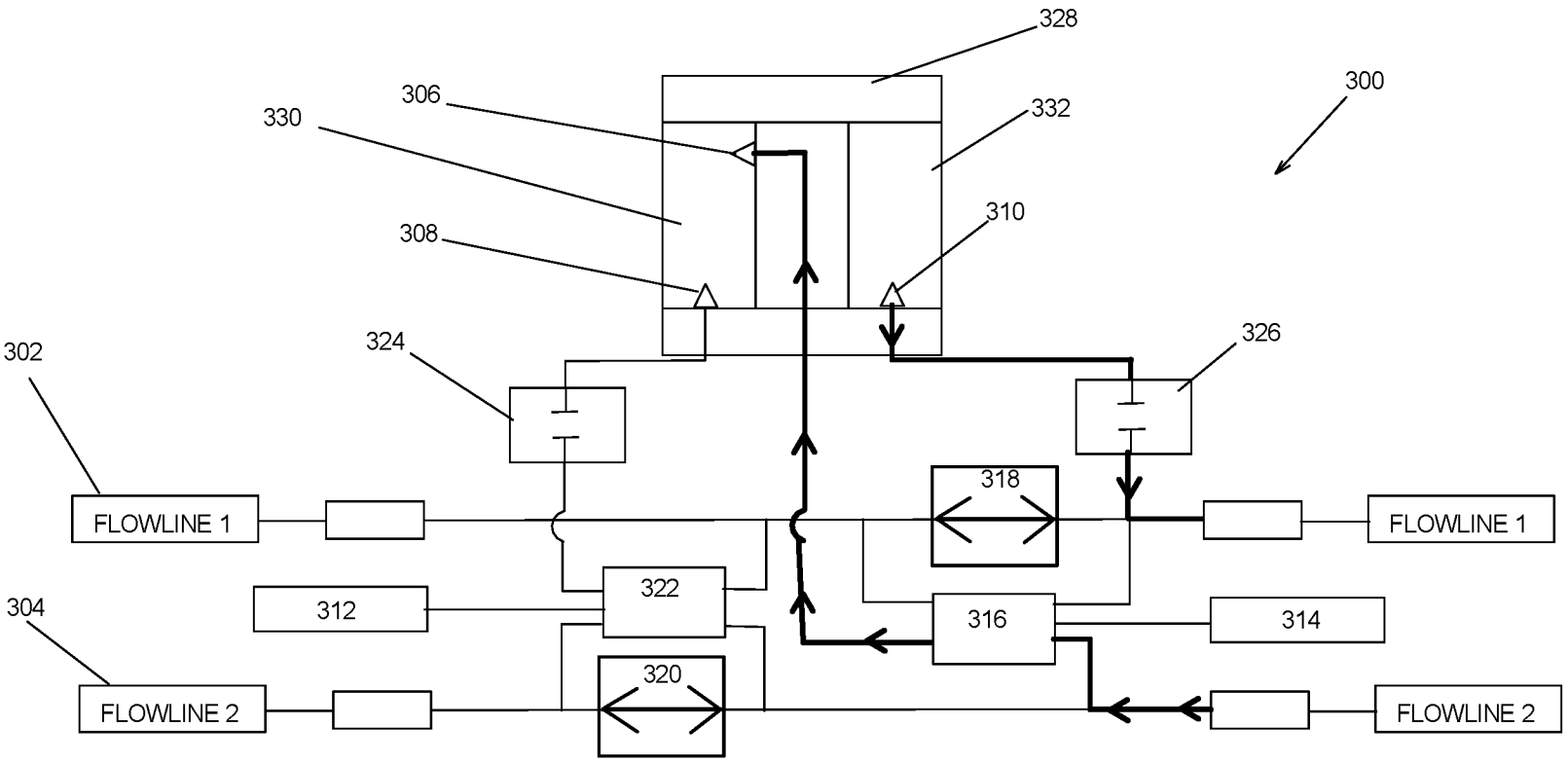
FIG. 7 is an embodiment of the hydraulic flow diagram of FIG. 3, showing a closed-loop configuration and flow of fluids between components.

With such an adaptable configuration through use of flow plugs and multiple connection possibilities to multiple positions within the tool, a closed loop system may be attained through operator action. Such closed loop features may be advantageously used compared to conventional apparatus. In one embodiment, fluid may be circulated within the tool, in multiple directions, and at low or high velocities, to allow for maintenance of the tool 200 in the downhole environment. An example flow diagram is presented in FIG. 7. Other configurations are possible. For example, it may be noticed by operators, that certain functions of sensors or downhole flow routing plugs have deteriorated over time. Such limitation of functions may be cleared by allowing fluid to flow continuously over these sections, to remove debris/sedimentation. In embodiments, fluid sampled from the external environment may be used for this purpose. In other embodiments, a "clean" fluid reservoir may be installed prior to deployment downhole for the purpose of allowing "clean" fluid to dislodge the debris/sedimentation. Such clearing activities are not possible with conventional apparatus that do not allow establishment of a closed loop configuration.

In embodiments, establishment of a closed loop configuration has further advantages not present in conventional apparatus. By establishing a closed loop configuration, in embodiments, gas and oil separation analysis may be conducted when the tool 200 is configured with such equipment, for example, a sample of fluid may be obtained from outside the tool 200. The fluid sample may be allowed to "sit" within a defined portion or portions of the tool 200. Over time, gaseous components may separate from fluid components, allowing separate sampling of different phases of the fluid obtained downhole. Such sampling may also include analysis of the volumes of such separation, providing operators with additional insights on downhole fluid conditions. As will be understood, existing sensor arrays or new sensor arrays designed for this purpose may be used to accomplish this task.

Figure 4:
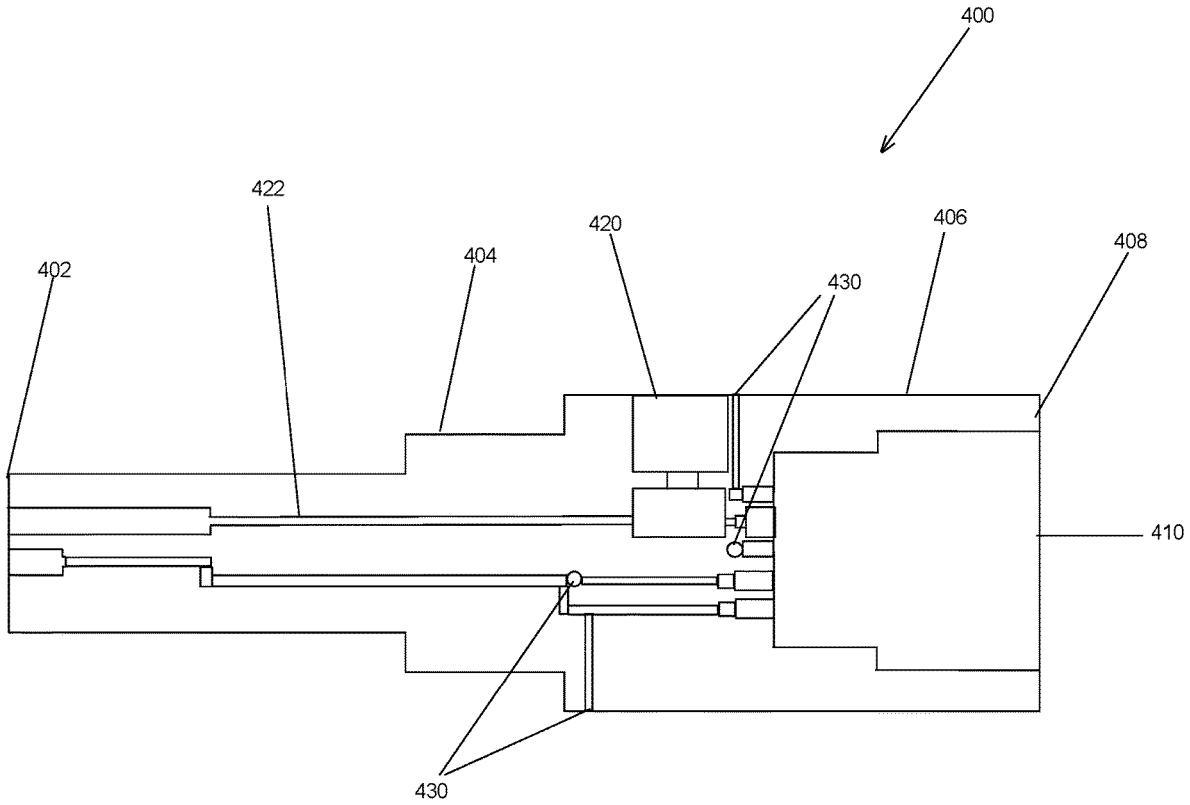
FIG. 4 is a side view of an adapter block in one example embodiment of the disclosure.

Lastly, a dedicated adapter 400 is illustrated in FIG. 4, to allow existing downhole tools to be retro-fitted to allow new functionality. Such an adapter 400 may allow for desired flow routing. In this embodiment, the adapter 400 eliminates the sample chamber 330. In this embodiment, the chamber and water lines are directly connected. When using this adapter 400, a conventional tool may be used for flow routing for use with the sample chamber 204 or upper head 202 in the tool 200 as illustrated in FIG. 2. In other embodiments, the adapter 400 may be used without the sample chamber 204 and upper head 202. Such a configuration would reduce the overall module weight and length by up to 75%. A smaller sample chamber may be used, thus saving on weight and size.

Operational control of the valves may be through a connected control system that allows for independent operation of each of the flow routing plugs 322, 316 as well as valves 320, 318 and valves within inlets 306, 310, 308 as equipped.

Figure 5:
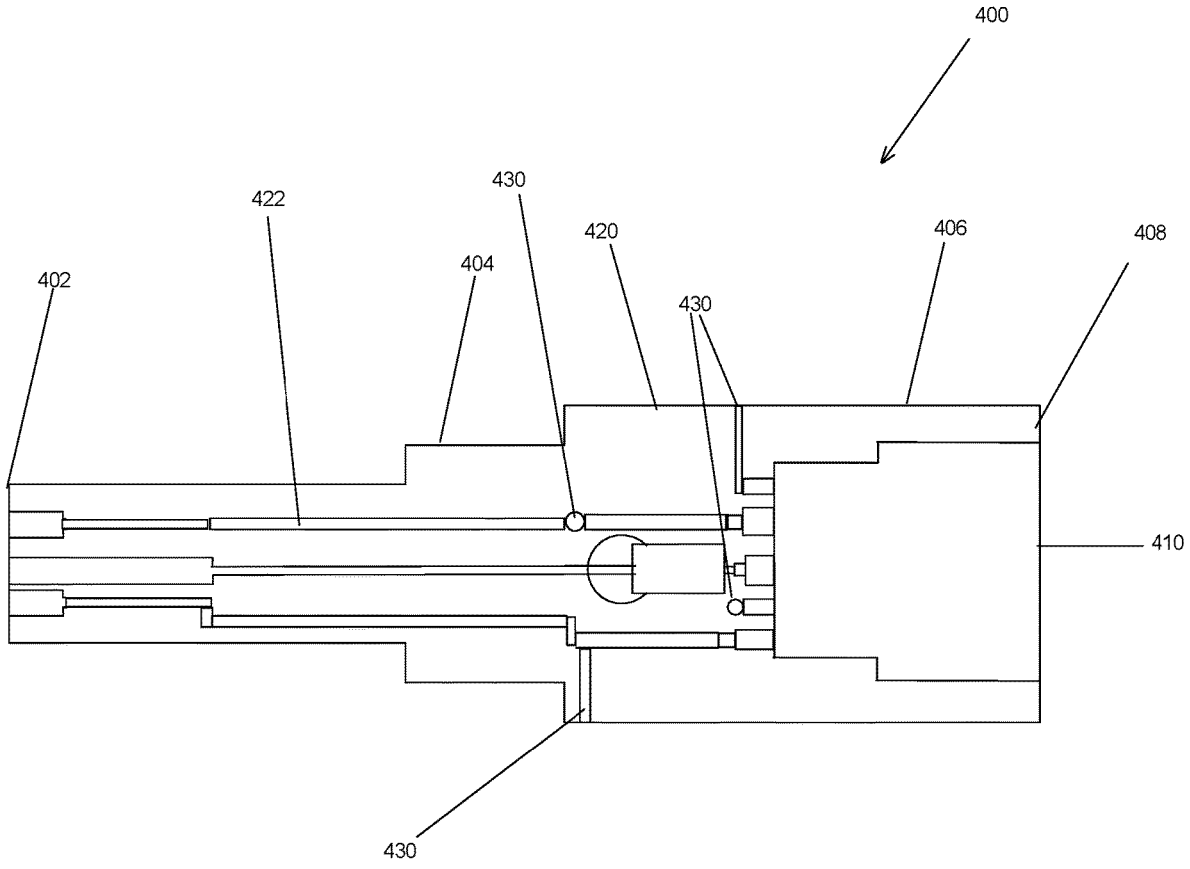
FIG. 5 is a second side view of the adapter block of FIG. 4 in a 90 degree rotated orientation.

Referring to FIGS. 4 and 5, a cross-sectional view of the adapter 400 is provided. The adapter 400 is provided with a first end 402 and a second end 408. The adapter 400 is configured with a mid-section 404 and a trunk section 406. The adapter 400 may be installed within a tool (not shown) through a connection recess 410. The connection recess 410 provides a mechanical connection point for the adapter 400 to the tool. Flow line 1 422 is used for taking samples at sample arrangement 420 allowing them to be transported to the first end 402 and ultimately a sample bottle within the sample chamber 204. Four independent guard lines 430 are located around the adapter 400 to allow for guard flow to be established per operation instruction. As will be understood, the individual guard line exits at the connection recess 410 may be connected such that the guard lines act in concert with one another, while the sampling occurs at flow line 1 422. The adapter 400 may be configured to eliminate the sample chamber and connect the chamber and water lines directly.

Embodiments of the downhole tool to be used with the adapter 400 may include a more compact sample bottle for storing samples. As illustrated, the four independent guard lines 430 may provide for 360 degree fluid flow from around the downhole tool. As will be understood, the ultimate inlet ports of the guard inlets may be modified from the positions shown on the adapter 400. Thus, the inlets may be in a single line in one configuration. There also may be more than one inlet per quarter section of exterior tool, thus in instances where a more even removal of fluids around the tool is required, a multiple inlet per quarter section of exterior tool may be provided. Connection of the adapter 400 may be through mechanical connections, such as screw fittings or push/lock fittings. In such mechanical connections, a leak tight junction between the adapter 400 and the remainder of the tool is desired.

Figure 6:
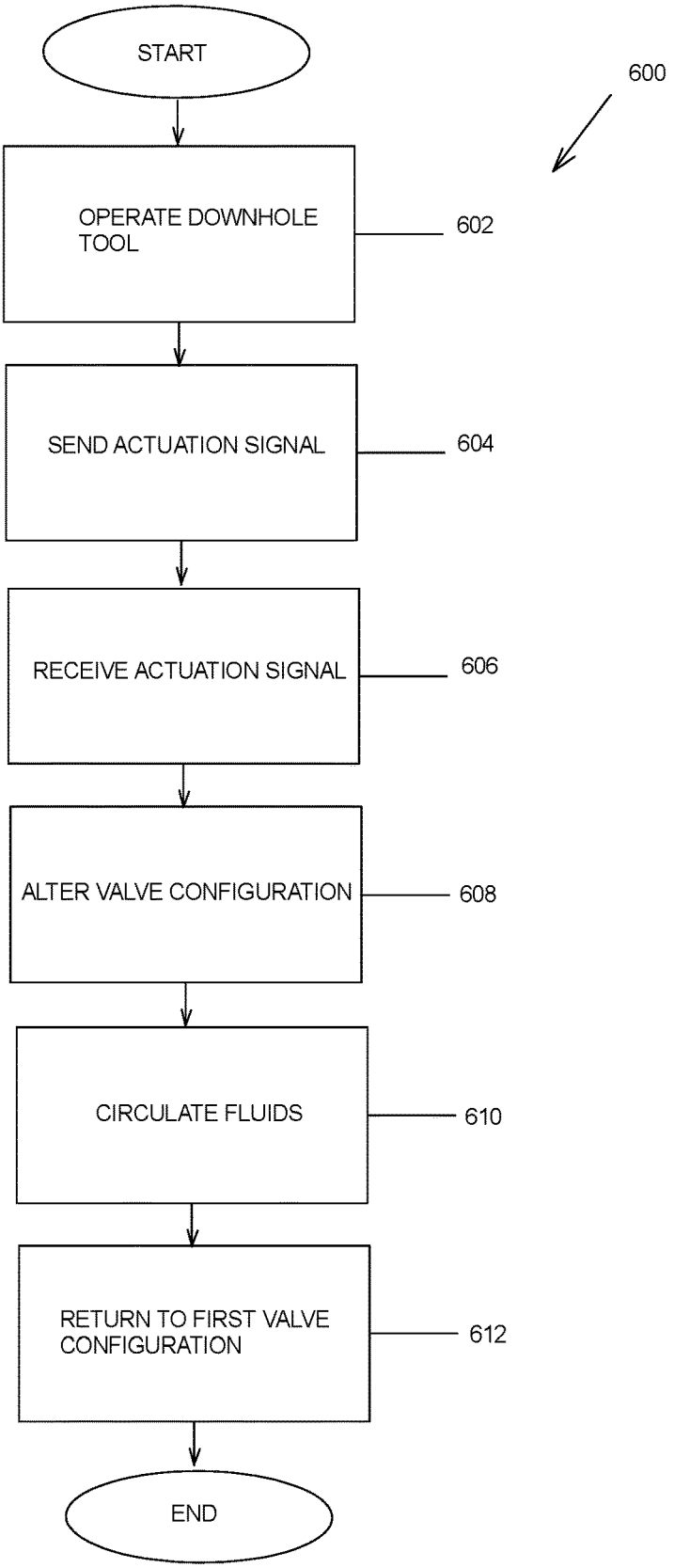
FIG. 6 is a method for performing dynamic multi-flowline control in a downhole tool in one example embodiment of the disclosure.

A method for operation of the system of FIG. 3 is also provided. Referring to FIG. 6, the method 600 involves, at 602, operating a downhole tool in a first valve configuration, the downhole tool configured to sample fluid from a geological stratum. At 604, the method continues with sending an actuation signal to the first valve configuration. At 606, the method continues with receiving the actuation signal at the first valve configuration. As will be understood, the first valve configuration may be, for example, the system 300 of FIG. 3. The method, at 608, continues with altering the first valve configuration to a second valve configuration, wherein the first valve configuration allows for sampling of fluids from the geological stratum outside the downhole tool to the second valve configuration wherein the downhole tool is configured to operate in a closed-loop configuration wherein sampling of fluids from the geological stratum is not possible. The method, at 610, continues with circulating fluids within the closed loop configuration. In embodiments, the circulating of the fluids may be operating a pump system within the downhole tool such that the fluids travel within the downhole tool at a velocity greater than a normal operating velocity of fluids during sampling. The method may also continue wherein step 610 continues until accumulated materials on a sensor arrangement within the downhole tool are dislodged by the travelling fluid. In further embodiments, the method may continue at step 612, with returning the valve configuration to the first valve configuration.

In one example embodiment, a multi-flowline control system is disclosed. The system may comprise a first flow routing plug and a second flow routing plug. The system may also comprise a piston configured with a first side and a second side. The system may also comprise a first flowline configured to transport a sample fluid and a second flowline configured to transport a guard fluid. The system may further comprise a first piston flow line extending from the first side of the piston to the first flow routing plug. The system may further comprise a second piston flow line extending from the first side of the piston to the second flow routing plug. The system may also comprise a third piston flow line extending from the piston second side to the second flow routing plug, wherein the first flow routing plug and the second flow routing plug are configured to switch flow entering the first flow routing plug and the second flow routing plug from a first configuration to a second configuration. The system may further comprise at least one fluid connection to the first flow line from the first flow routing plug. The system may further comprise at least one fluid connection to the first flow line from the second flow routing plug to the first flowline. The system may also comprise at least two fluid connections to the second flowline from the first routing plug. The system may also comprise at least one fluid connection to the second flowline from the second flow routing plug. The system may also comprise a first flow routing plug controller connected to the first flow routing plug, the first flow routing plug controller configured to switch from the first configuration to the second configuration. The system may also comprise a second flow routing plug controller connected to the second flow routing plug, the second flow routing plug controller configured to switch from the first configuration to the second configuration.

In another example embodiment, the multi-flowline control system may further comprise at least one valve placed on the second flowline.

In another example embodiment, the multi-flowline control system may further comprise at least one valve on the first flowline.

In another example embodiment, the multi-flowline control system may further comprise a valve placed on the first piston flow line.

In another example embodiment, the multi-flowline control system may further comprise a valve placed on the third piston flow line.

In one example embodiment, a method for dynamically switching fluid flow in a downhole tool is disclosed. The method may comprise operating the downhole tool in a first valve configuration, the downhole tool configured to sample fluid from a geological stratum. The method may further comprise sending an actuation signal to the first valve configuration. The method may further comprise receiving the actuation signal at the first valve configuration. The method may further comprise altering the first valve configuration to a second valve configuration, wherein the first valve configuration allows for sampling of fluids from the geological stratum outside the downhole tool to the second valve configuration wherein the downhole tool is configured to operate in a closed-loop configuration wherein sampling of fluids from the geological stratum is not possible. The method may also comprise circulating fluids within the closed loop configuration.

In another example embodiment, the method may be performed wherein the circulating of the fluids in the closed loop configuration is through a pump.

In another example embodiment, the method may be performed wherein the circulating of the fluids is at a velocity greater than a sampling velocity within the downhole tool.

In another example embodiment, the method may be performed wherein during the circulating of the fluids, materials on a sensor arrangement in the downhole tool are dislodged.

In another example embodiment, the method may further comprise returning the valve configuration to the first configuration.

In another example embodiment, an adapter is disclosed. The adapter may comprise a body with a first end and a second end, wherein the second end is configured to attach to a valve block. The adapter may also comprise a sample inlet within the body, the sample inlet configured to abut to a geological stratum. The adapter may also comprise a first fluid flow extending from the first end to the second end and to the sample inlet. The adapter may also comprise at least three guard flow lines extending from the first end to the second end and wherein each guard flow line has an inlet extending through a side of the body.

In another example embodiment, the adapter may be configured wherein the second end is configured with threads.

In another example embodiment, the adapter may have a first end that is configured with a mechanical connection.

In another example embodiment, a method for dynamically switching fluid flow in a downhole tool is disclosed. The method may comprise operating the downhole tool in a first valve configuration, the downhole tool configured to sample fluid from a geological stratum, wherein a sampling of fluids from an environment outside the downhole tool is accomplished. The method may also comprise sending, from an up-hole environment, an actuation signal to the first valve configuration located in a down-hole environment. The method may also comprise receiving the actuation signal at the first valve configuration. The method may also comprise altering the first valve configuration to a second valve configuration, wherein the downhole tool is configured to operate in a closed-loop configuration, wherein sampling of fluids from the geological stratum is not possible. The method may also comprise circulating fluids within the closed-loop configuration.

In another example embodiment, the method may be accomplished wherein the circulating of fluids within the closed-loop configurations dislodges accumulated debris within the downhole tool.

In another example embodiment, the method may be accomplished, wherein the circulating of the fluids within the closed-loop configuration originates from a fluid source carried within the tool from the up-hole environment.

In another example embodiment, the method may be accomplished, wherein the circulating of the fluids within the closed-loop configuration includes fluids passing through at least one of a sensor array and a flow routing plug.

In another example embodiment, the method may be accomplished, wherein the circulating of the fluids is accomplished through at least one pump.

In another example embodiment, the method may be accomplished, wherein the at least one pump is controlled such that different velocities of fluid within the closed-loop configuration are achieved.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A multi-flowline control system, comprising:

a first flow routing plug;

a second flow routing plug;

a piston configured with a first side and a second side;

a first flowline configured to transport a sample fluid;

a second flowline configured to transport a guard fluid;

a first piston flowline extending from the first side of the piston to the first flow routing plug;

a second piston flowline extending from the first side of the piston to the second flow routing plug;

a third piston flowline extending from the second side of the piston to the second flow routing plug, wherein the first flow routing plug and the second flow routing plug are configured to switch flow entering the first flow routing plug and the second flow routing plug from a first configuration to a second configuration;

at least one fluid connection to the first flowline from the first flow routing plug;

at least one fluid connection to the first flowline from the second flow routing plug to the first flowline;

at least two fluid connections to the second flowline from the first flow routing plug;

at least one fluid connection to the second flowline from the second flow routing plug;

a first flow routing plug controller connected to the first flow routing plug, the first flow routing plug controller configured to switch from the first configuration to the second configuration; and a second flow routing plug controller connected to the second flow routing plug, the second flow routing plug controller configured to switch from the first configuration to the second configuration.

2. The multi-flowline control system according to claim 1, further comprising at least one valve placed on the second flowline.

3. The multi-flowline control system according to claim 1, further comprising at least one valve on the first flowline.

4. The multi-flowline control system according to claim 1, further comprising a valve placed on the first piston flowline.

5. The multi-flowline control system according to claim 1, further comprising a valve placed on the third piston flowline.

* * * * *